US008496406B2

(12) United States Patent
Hertgers

(10) Patent No.: US 8,496,406 B2
(45) Date of Patent: Jul. 30, 2013

(54) POSITIONING A SINKING TUNNEL SECTION

(75) Inventor: Gerrit Martinus Hertgers, Leusden (NL)

(73) Assignee: Strukton Civiel Projecten B.V., Utrecht (NL)

( * ) Notice: Subject to any disclaimer, the term of this patent is extended or adjusted under 35 U.S.C. 154(b) by 202 days.

(21) Appl. No.: 12/809,891

(22) PCT Filed: Dec. 20, 2007

(86) PCT No.: PCT/EP2007/064311

§ 371 (c)(1), (2), (4) Date: Aug. 9, 2010

(87) PCT Pub. No.: WO2009/080102

PCT Pub. Date: Jul. 2, 2009

(65) Prior Publication Data

US 2010/0310318 A1 Dec. 9, 2010

(51) Int. Cl.
*E02D 29/063* (2006.01)

(52) U.S. Cl.
USPC ..... 405/136

(58) Field of Classification Search
USPC ..... 405/3, 136, 158, 195.1, 196–199, 405/200
See application file for complete search history.

(56) References Cited

U.S. PATENT DOCUMENTS 2,600,761 A * 6/1952 Halliburton ..... 405/197
3,713,414 A * 1/1973 Wischhoefer et al. ..... 114/50
3,893,304 A * 7/1975 Pochitaloff-Huvale et al. ..... 405/136
3,928,982 A * 12/1975 Lacroix ..... 405/224
4,020,777 A * 5/1977 Brown et al. ..... 114/258
4,648,745 A * 3/1987 Hulsbergen ..... 405/159
4,714,375 A * 12/1987 Stevenson et al. ..... 405/3
4,832,530 A * 5/1989 Andersen et al. ..... 405/170
5,154,561 A * 10/1992 Lee ..... 414/138.3

(Continued)

FOREIGN PATENT DOCUMENTS

GB 1314424 * 4/1973
JP 10082062 3/1998

(Continued)

OTHER PUBLICATIONS

Notification of Transmittal of the International Search report and the Written Opinion of the International Searching Authority, or the Declaration (3 pages); International Search Report (5 pages); and Written Opinion of the International Searching Authority (6 pages), of related International Application No. PCT/EP2007/064311, mailed Oct. 29, 2008.

*Primary Examiner* — Thomas B Will
*Assistant Examiner* — Patrick Lambe
(74) *Attorney, Agent, or Firm* — Fish & Richardson P.C.

(57) ABSTRACT

A positioning apparatus includes a frame and two substantially vertically extending legs. The frame includes a suspension device adapted to suspend a sinking tunnel section. The legs include upper ends connected by a substantially horizontally extending beam and lower ends vertically movable relative to the sinking tunnel section. The legs include clamping members for engaging opposite transverse sides of the tunnel section that are settable substantially in a plane defined by the legs and beam of the frame. The frame is devised for extending with its legs outwardly of the two opposite transverse sides of the tunnel section and extending with the beam above a roof of the tunnel section.

20 Claims, 8 Drawing Sheets

U.S. PATENT DOCUMENTS

| | | | | |
|---|---|---|---|---|
| 6,318,931 | B1 * | 11/2001 | Khachaturian | 405/204 |
| 6,668,746 | B1 * | 12/2003 | Schia et al. | 114/264 |
| 6,840,713 | B1 * | 1/2005 | Schia et al. | 405/209 |
| 7,603,959 | B1 * | 10/2009 | Veazey | 114/263 |
| 2003/0140837 | A1 * | 7/2003 | O'Neil et al. | 114/259 |

FOREIGN PATENT DOCUMENTS

| | | |
|---|---|---|
| JP | 10088596 | 4/1998 |
| JP | 10280449 | 10/1998 |
| NL | 8902656 | 5/1990 |

* cited by examiner

POSITIONING A SINKING TUNNEL SECTION

CROSS-REFERENCE TO RELATED APPLICATIONS

This application is the U.S. national stage under U.S.C. §371 of International Application Number PCT/EP2007/064311, filed on Dec. 20, 2007, the entire contents of which are hereby incorporated by reference.

TECHNICAL BACKGROUND

This disclosure relates to an apparatus for positioning a sinking tunnel section.

BACKGROUND

One of the problems encountered when constructing a tunnel under water by sinking and interconnecting consecutive sinking tunnel sections is to ensure a correct position of a tunnel section relative to the tunnel part (tunnel sections) already positioned on the sea bottom, river bed or alike. Due to environmental conditions such as waves, current and wind a correct positioning of the tunnel section is extremely difficult, if not impossible and often requires complicated repositioning manoeuvres after the initial positioning of the tunnel section on the sea bottom, river bed or alike. It will be clear that, among others, due to the immense weight and bulkiness of such tunnel sections such manoeuvres require specialised equipment, are time consuming and often create dangerous working environments.

Thus it is an object of the present disclosure to provide an improved apparatus for positioning a sinking tunnel section.

SUMMARY

In accordance with the present disclosure the apparatus for positioning a sinking tunnel section comprises a frame with two substantially vertically extending legs which at their upper ends are connected by a substantially horizontally extending beam, which frame is devised for extending with its legs outwardly of two opposite transverse sides of the tunnel section and extending with its beam above the roof of the tunnel section, wherein the frame is provided with a suspension device from which the tunnel section can be suspended, and wherein the lower ends of the legs are vertically movable relative to the sinking tunnel section and the legs each are provided with clamping members for engaging said opposite transverse sides of the tunnel section, which clamping members are settable substantially in the plane defined by the legs and beam of the frame.

Using the apparatus according to the present disclosure it is possible to lift the tunnel section from the sea bottom, river bed or alike by moving the lower ends of the legs of the frame vertically downwards relative to and beyond the lower part of the tunnel section. Because of the substantial weight of the tunnel section, the lower ends of the legs will firmly engage the sea bottom, river bed or alike and will assume a very stable position relative thereto. Such stable position of the legs is transformed into an equally stable position of the tunnel section by means of the engagement of the clamping members with the transverse sides of the tunnel section. Thus, at one hand, the clamping members may stabilize the position of the tunnel section while being positioned (for example during the last stage of lowering it) relative to the tunnel part already in position. At the other hand, however, the clamping members also may be used to correct the position of the tunnel section relative to the tunnel part already positioned, for example to enable a correct alignment therebetween and for optimizing the operation of a seal present therebetween.

Although it would be possible to provide legs with a constant length and to realize the relative movement between the tunnel section and the lower end of the legs by lifting the tunnel section by means of the suspension means, in a preferred embodiment of the apparatus according to the disclosure, the length of the legs of the frame can be varied. For example, this means that the legs are constructed in such a manner that their length can be increased or decreased. By increasing the length of the legs the tunnel section automatically will be lifted when the lower ends of the legs engage the sea bottom, river bed or alike.

Constructively, it is possible that the lower end of each leg defines a foot which is movable relative to the remainder of the leg. For example, most of the leg has a constant configuration and that only its lower part (foot) will be moved to alter the length of the leg for moving its lower end (foot) relative to the tunnel section.

For obtaining such a movement of the foot it is possible, in one embodiment, that the foot is connected to the remainder of the leg by at least one cylinder piston assembly. Cylinder piston assemblies have proved their reliable operation under water and are able of creating large forces. However, as will be appreciated by an expert, other drive mechanisms for moving the foot are also conceivable.

The transmission of forces may be optimized when the clamping members are provided on said feet of the legs. This means that a direct force transmission is created from the sea bottom, river bed or alike (which is engaged by the feet of the frame) towards the tunnel section.

Further, in accordance with yet another preferred embodiment of the apparatus according to the disclosure, the lower end of the legs is provided with protrusions for enhancing the grip on the sea bottom, river bed or alike. Such protrusions, for example, may be provided on the lower side of the feet, if applied.

Preferably the clamping members comprise cylinder piston assemblies. The advantages thereof are as set out above with respect to the cylinder piston assemblies for moving the feet.

When, in accordance with another embodiment of the apparatus according to the disclosure, the legs are hingedly connected to the beam, the position of the legs relative to the beam (and, thus, relative to the tunnel section) may be optimized with respect to loads acting on and in the frame, for example by offering the legs a slightly sloping position (for example diverging in a downward direction).

In such a case it is possible too that the legs are collapsible to a position in which they extend substantially in parallel and close to the beam. In such a position the frame has a compact shape which is favourable for its transport, for example by a floating pontoon (as in an embodiment of the disclosure to be described later).

Preferably, then, the apparatus comprises a driver for causing the relative hinging motion between the legs and the beam, such as for example cylinder piston assemblies or a hoist extending between the beam and the legs.

For enhancing the stability of the position of the legs, especially when the clamping members are in the process of repositioning the tunnel section, it is possible that the lower ends of the legs are interconnected by a tension member, such as for example a cable.

The applicability of the apparatus according to the present disclosure may be broadened when the length of the beam is variable. As a result the apparatus can cope with production tolerances of the tunnel sections, and may be used in combination with tunnel sections having different widths.

When, in accordance with an embodiment of the apparatus according to the disclosure, the frame in its upper part is provided with stop members for engaging the tunnel section, unfavourable forces acting on the parts of the tunnel section that are engaged by the suspension device of the frame may be minimised, especially in cases in which the legs do not extend exactly vertically.

Preferably such stop members are settable.

The use of the apparatus according to the disclosure is facilitated when the suspension device of the beam is devised for cooperation with standardized hoisting lugs of the tunnel section. This means that no, or just minimal, adaptations of the tunnel section are needed for enabling its cooperation with the apparatus according to the disclosure. This lowers the cost of the use of the apparatus and shortens the time needed for establishing a connection between the tunnel section and the apparatus.

In an embodiment the apparatus according to the disclosure further comprises a floating pontoon comprising a lifting device attached to the frame. Such a pontoon can manoeuvre the apparatus in a very reliable manner, both during transport of the tunnel section from its production site towards its application site as well as during sinking of the tunnel section.

In such a case it is preferred that the lifting device is devised for cooperation with standardized hoisting lugs of the tunnel section. Thus the frame engages such hoisting lugs through the lifting device.

Finally an embodiment is mentioned in which the pontoon comprises two sets of lifting devices spaced apart (in its longitudinal direction) and each attached to a separate frame. The frames are intended to engage a tunnel section near both opposite longitudinal ends thereof. Thus the tunnel section will obtain a stable position during all stages of sinking and positioning it.

DESCRIPTION OF DRAWINGS

Hereinafter the disclosure will be elucidated while referring to the drawing, in which.

DETAILED DESCRIPTION

Figure 2:
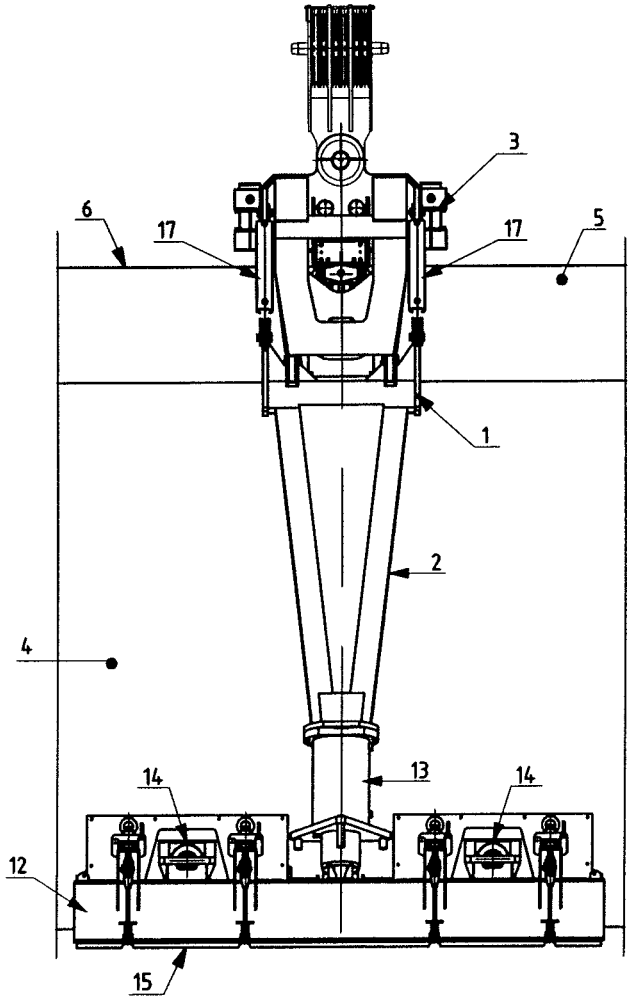
FIG. 2 is a side elevation view according to II in FIG. 1.
Figure 3:
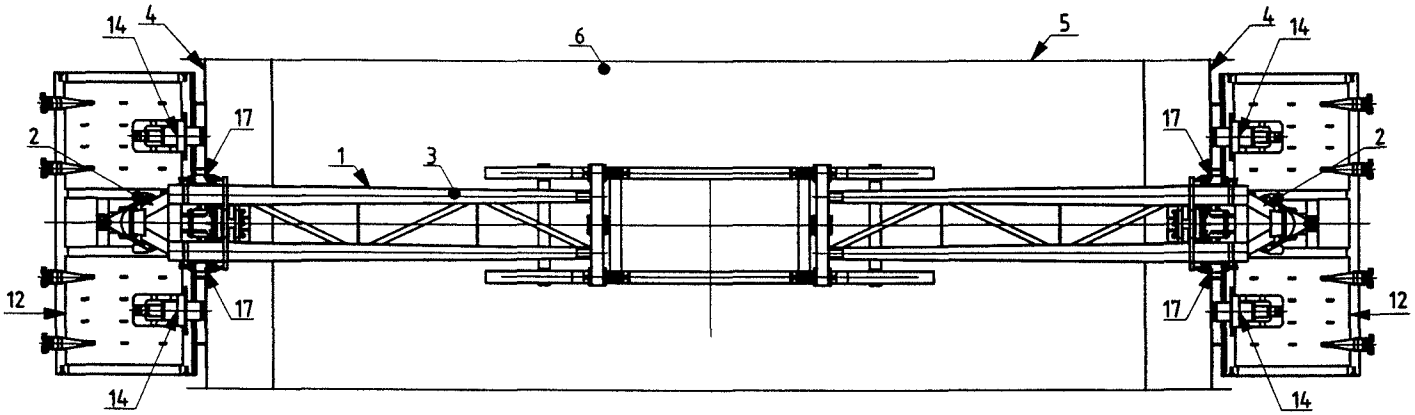
FIG. 3 is a top plan view according to III in FIG. 1.

Firstly referring to FIGS. 1-3 an embodiment of the apparatus for positioning a sinking tunnel section will be described. Basically the apparatus comprises a frame 1 with two substantially vertically extending legs 2 which at their upper ends are connected by a substantially horizontally extending beam 3.

It is noted that notwithstanding the specific embodiment shown, the legs 2 and beam 3 of the frame 1 can have many different configurations, as long as the legs are capable of assuming a (nearly) vertical position and as long as the legs are connected by said beam. Thus, although FIG. 1 shows the beam 3 having in its mid section members engaging the top of the tunnel section, such members also may be omitted, for example.

Figure 1:
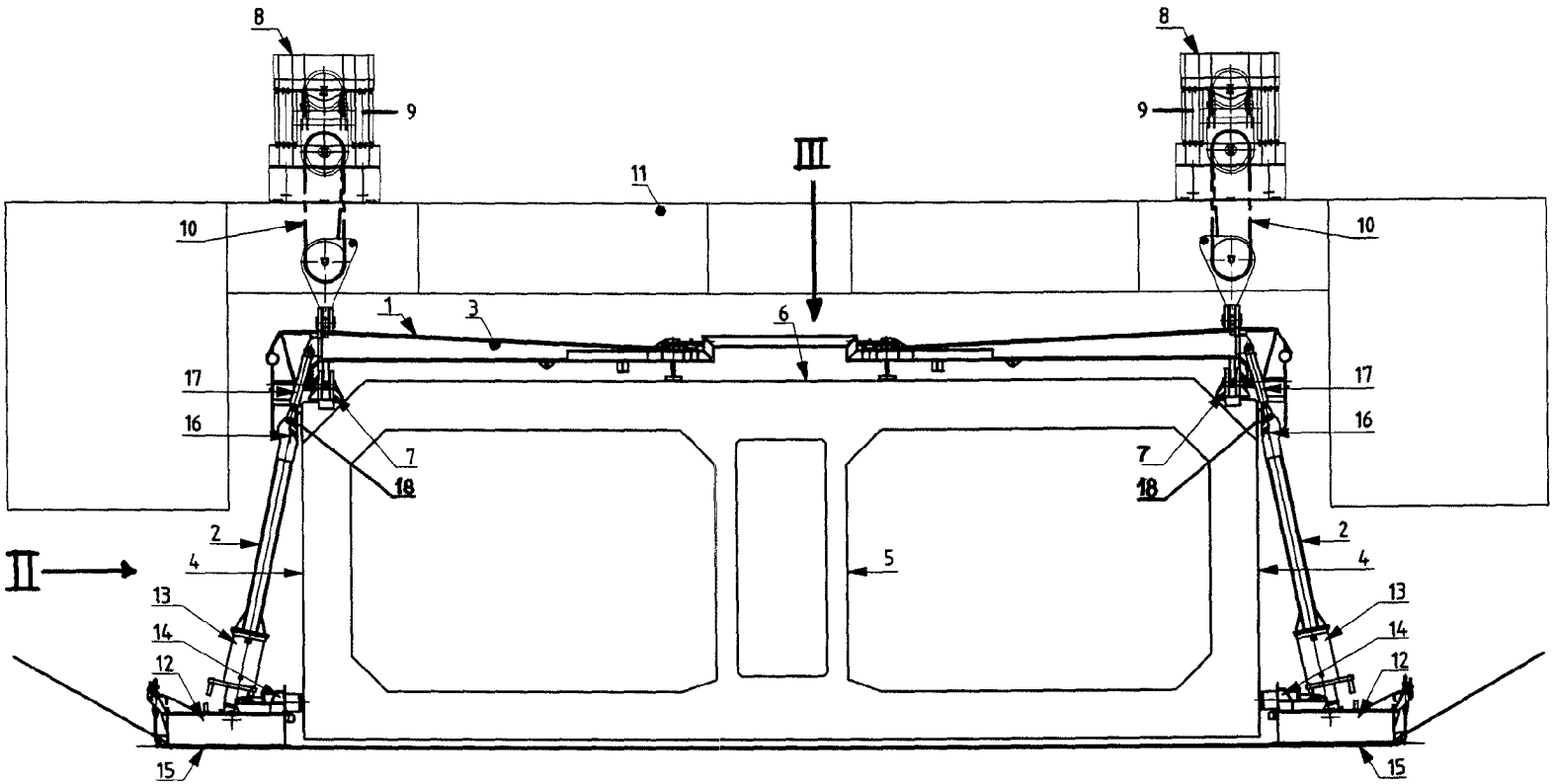
FIG. 1 shows in a frontal view an embodiment of the apparatus according to the disclosure as mounted on a tunnel section.

As best illustrated in FIG. 1, said frame 1 is devised for extending with its legs 2 outwardly of two opposite transverse sides 4 of a tunnel section 5, whereas its beam 3 will extend (substantially horizontally) above the roof 6 of the tunnel section 5.

The frame 1 is provided with a suspension device 7 from which the tunnel section 6 can be suspended. Said suspension device 7 of the beam 3 are devised for cooperation with standardized hoisting lugs of the tunnel section 6 (not illustrated in detail here). The frame 3 itself is suspended from lifting device 8 (such as for example winches 9 with lifting cables 10) mounted on a floating pontoon 11 (this pontoon 11 is only shown in FIG. 1). These lifting device 8 generally too are devised for cooperation with the standardized hoisting lugs of the tunnel section.

It is noted that in most cases the apparatus according to the present disclosure will be used for manoeuvring long tunnel sections (up to many tenths of meters long), and therefore generally the pontoon 11 will comprise two sets of lifting devices 8 (each set comprising two lifting devices 8) spaced apart in the longitudinal direction of the pontoon 11 (in FIG. 1 perpendicularly to the drawing) and each attached to a separate frame 1. Thus there are then two frames 1 which will cooperate with opposite longitudinal ends of the tunnel section 5.

The lower end of each leg 2 defines a foot 12 intended for engaging the sea bottom, river bed or alike. Each foot 12 is movable vertically relative to the remainder of the leg 2, which means that lower ends of the legs are vertically movable relative to the sinking tunnel 5 and that the length of the legs 2 of the frame 1 can be varied. In the illustrated embodiment the feet 12 are connected to the remainder of the respective legs 2 by means of cylinder piston assemblies 13, activation of which will vary the position of a foot 12 relative to the leg 2 and thus relative to the tunnel section 5.

The feet 12 each are provided with clamping members 14 for engaging the opposite transverse sides 4 of the tunnel section 5. These clamping members 14 in the illustrated embodiment comprise cylinder piston assemblies such that the clamping members are settable substantially in a plane defined by the legs and beam of the frame (towards and away from the transverse sides 4 of the tunnel section 5).

Whereas in the illustrated embodiment the clamping members 14 are provided on said feet 12 of the legs 2, it is conceivable too that the clamping members are attached to the legs 2 at a position above the feet 12.

As illustrated in FIG. 1, the lower end of the feet 12 is provided with protrusions 15 for enhancing the grip on the sea bottom, river bed or alike.

The legs 2 are hingedly connected to the beam 3 by means of a hinge 16 (best illustrated in FIG. 1). As a resuit the position of the legs 2 relative to the beam 3 (but also relative to the tunnel section 5) can be varied. For example the legs 2 may be collapsible to a position in which they extend substantially in parallel and close to the beam 3 (see FIG. 4 below), in which position a transport of the frame (which may occur over large distances, from an application site of the tunnel sections towards a construction site thereof) is facilitated.

Generally a driver for causing the relative hinging motion between the legs 2 and the beam 3 will be provided, such as (in the illustrated embodiment) cylinder piston assemblies 17. However, said driver also may comprise a hoist extending between the beam and the legs, for example cables (not shown) connected with one end to the lower ends of the legs and with the other end to a winch or alike mounted on the beam (or on the pontoon).

The lower ends of the legs 2 (the feet 12) may be interconnected by a tension member, such as for example a cable (not illustrated) which then will extend underneath the tunnel section 5 and which will add to the stability of the frame 1 in general and of the legs 2 in particular.

Further the length of the beam 3 may be variable, for coping with production tolerances of the tunnel sections.

In its upper part the frame 1 is provided with stop members 18 for engaging the tunnel section, which stop members may be settable (e.g. by cylinder piston assemblies).

Next, referring to the schematic FIGS. 4-8, the operation of the apparatus will be elucidated.

Figure 4:
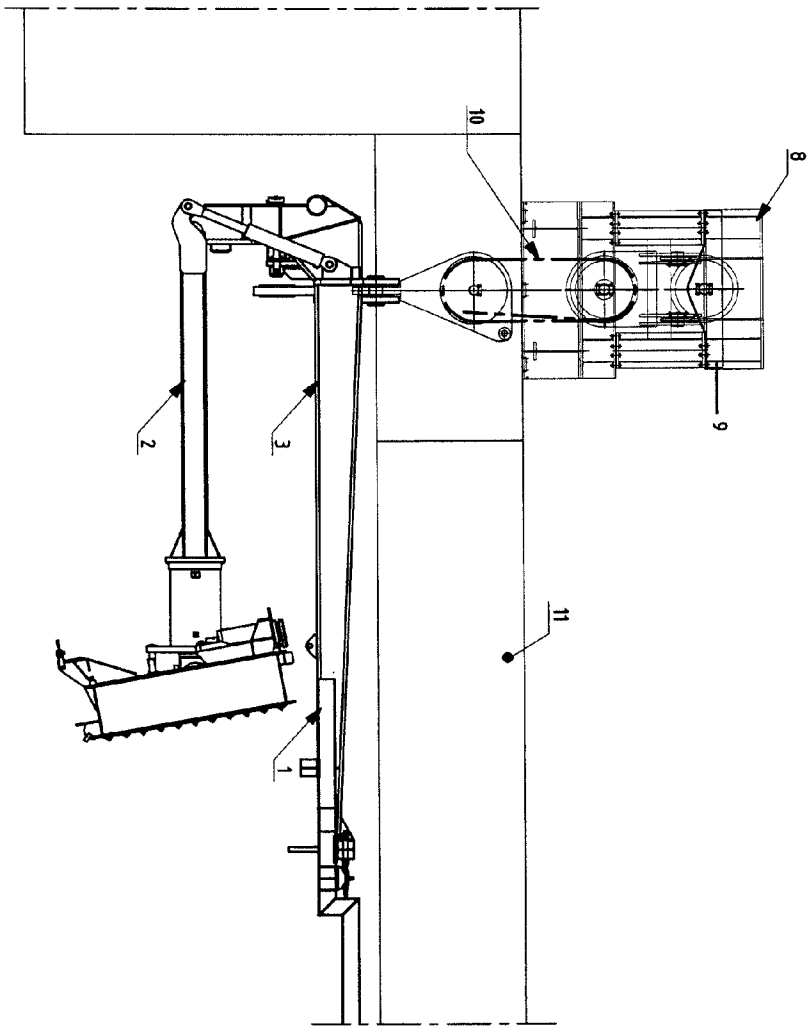
FIGS. 4-8 are schematic views illustrating successive stages of the use of an apparatus according to the present disclosure.

In FIG. 4 the frame 1 is suspended from the pontoon 11 by the lifting device 8. The legs 2 are hinged to a position in which they extend substantially in parallel to the beam 3 (the hinges 16 are not illustrated here, but are visible in FIG. 1). In this configuration the pontoon 11 can transport the apparatus without a tunnel section.

Figure 5:
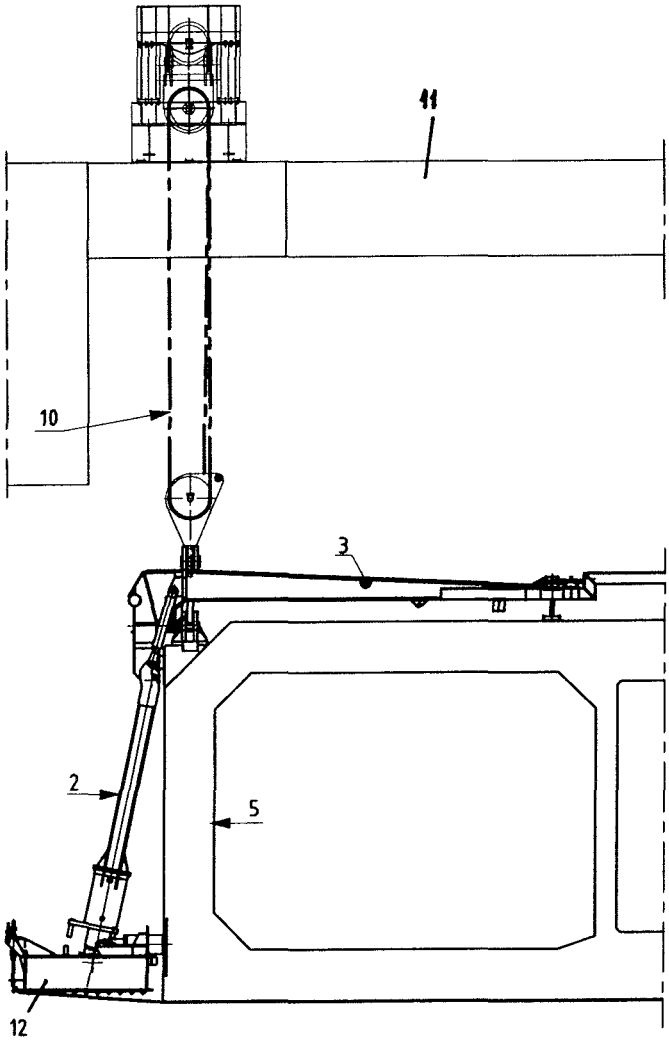

In FIG. 5 the legs 2 extend substantially vertically and a tunnel section 5 is received between the legs 2 and below the beam 3. The lifting cables 10 are connected to the frame and thus to the tunnel section 5, which in this manner can be transported towards its application site and there can be sunk towards the sea bottom, river bed or alike in proximity of the tunnel part (tunnel sections) already positioned there.

Figure 6:
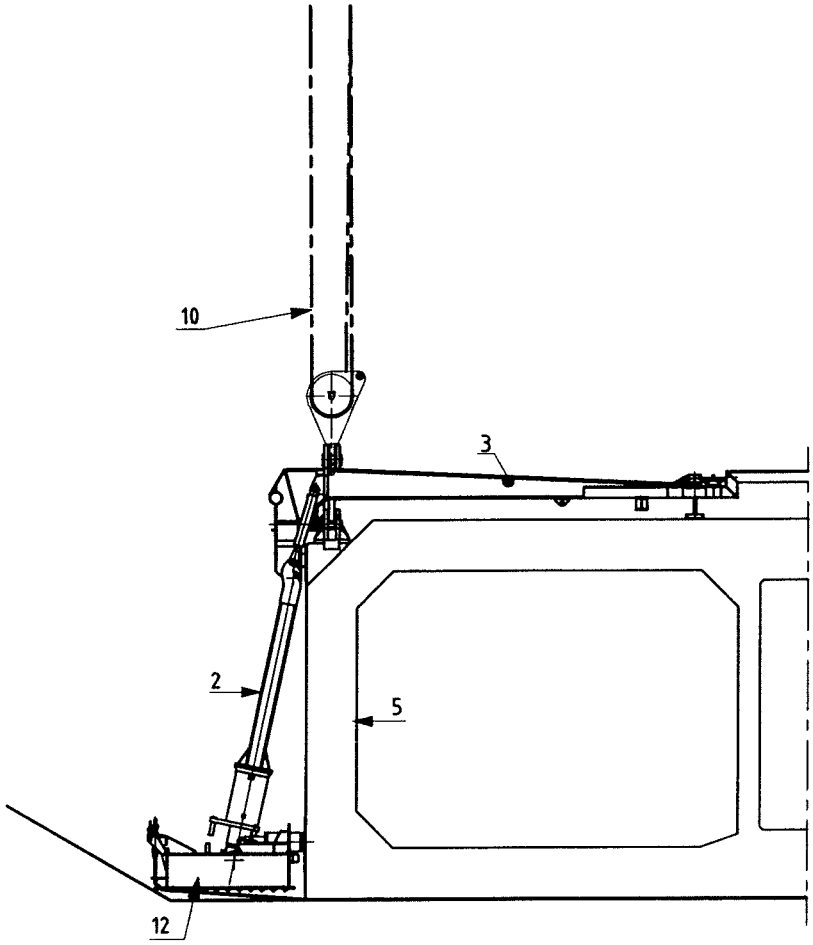
Figure 7:
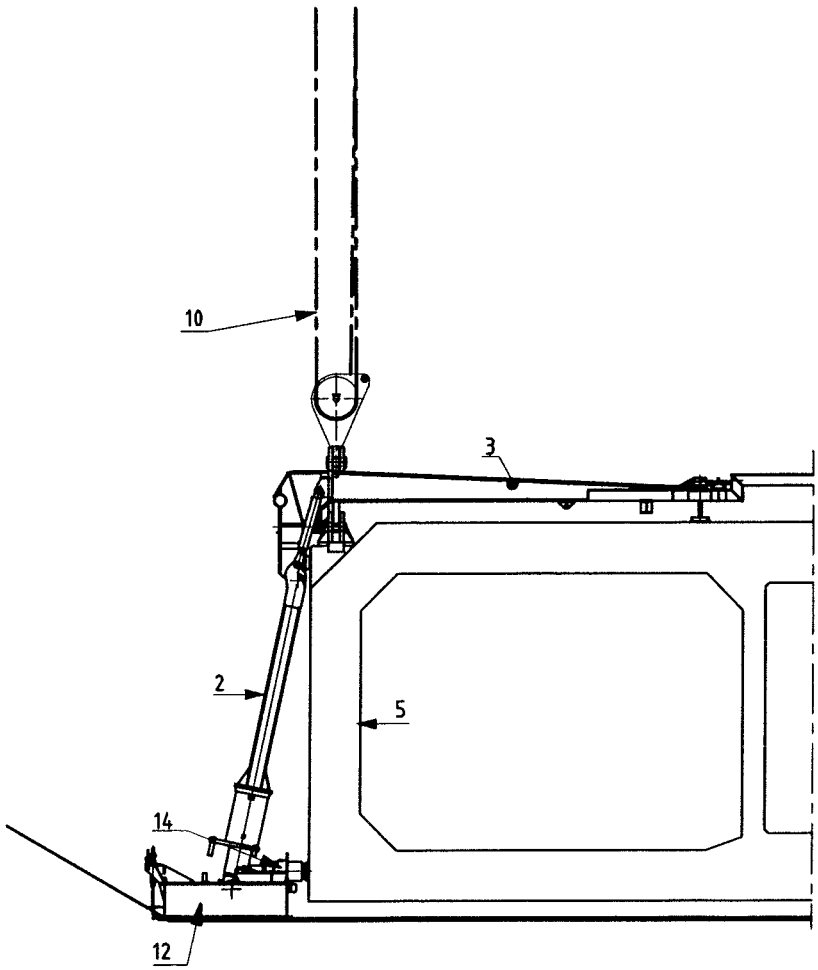
Figure 8:
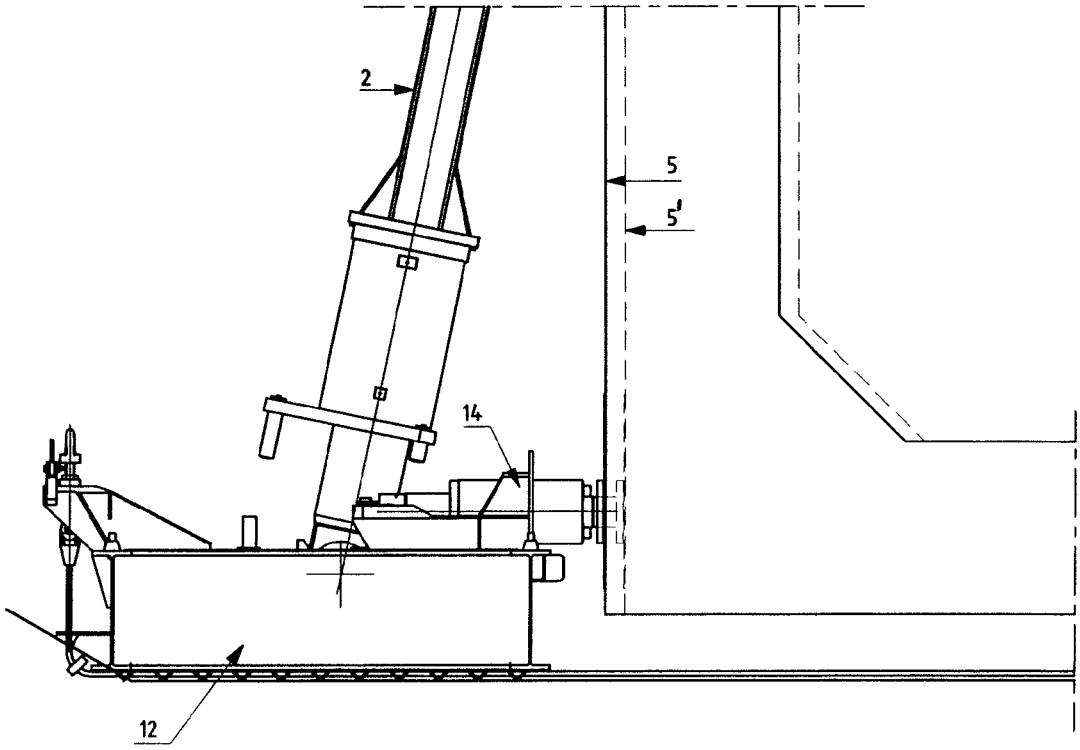

According to FIG. 6 the tunnel section has reached the sea bottom, river bed or alike. Next, as illustrated in FIG. 7, the feet 12 of the legs 2 are lowered, as a result of which the tunnel section 5 is slightly lifted from the sea bottom, river bed or alike. In this situation, in which the frame has obtained a stable position (aided by the weight of the tunnel section) the clamping members 14 on the feet are activated for engaging the tunnel section 5. For example these clamping members 14 may be activated (extended and retracted) in such a manner that the tunnel section at the respective end is moved transversely (for example to obtain a proper alignment with a previously positioned tunnel section or to improve a seal therebetween). FIG. 8 illustrates a sideward shift of the tunnel section 5' in dotted lines (by extending a clamping member 14 at one side of the tunnel section while retracting the other one at the other side).

If a sideward correction of the tunnel section is needed exceeding the possible movement of the clamping members, it is possible to move the clamping members to their end position, to lower the tunnel section by moving the feet upwards, to move the clamping members back to the starting position and to then lift the tunnel section again, after which the clamping members can be activated again. As such, the apparatus is able of "walking" sidewards step by step.

Finally, one or more tension devices spanning the interface between two successive tunnel sections can be used to tension the tunnel section against its predecessor. Such tensioning devices (not shown) may comprise cylinder piston assemblies, as is known per se.

The disclosure is not limited to the embodiments described before which may be varied widely within the scope as defined by the appending claims.

The invention claimed is:

1. A positioning apparatus, comprising:

a frame comprising a suspension device adapted to suspend a sinking tunnel section;

two substantially vertically extending legs that comprise: upper ends connected by, and hingedly connected to, a substantially horizontally extending beam of the frame, and lower ends vertically movable relative to the sinking tunnel section, the legs further comprising clamping members for engaging opposite transverse sides of the tunnel section; and one or more lifting devices attached to the frame, each of the lifting devices devised to independently move the beam bi-directionally in a path substantially orthogonal to the substantially horizontally extending beam, each of the clamping members settable to urge the sinking tunnel section bi-directionally in a path substantially parallel to a lengthwise dimension of the substantially horizontally extending beam independently of movement of the frame by the lifting devices.

2. The apparatus according to claim 1, wherein the length of the legs of the frame is variable to (1) move the beam bi-directionally in the path substantially orthogonal to the substantially horizontally extending beam, and (2) move the sinking tunnel section bi-directionally in the path substantially parallel to the lengthwise dimension of the substantially horizontally extending beam independently of the lifting devices and the clamping members.

3. The apparatus according to claim 2, wherein the lower end of each leg defines a foot which is movable relative to the remainder of the leg.

4. The apparatus according to claim 3, wherein the foot is connected to the remainder of the leg by at least one cylinder piston assembly.

5. The apparatus according to claim 3, wherein the clamping members are provided on said feet of the legs.

6. The apparatus according to claim 1, wherein the lower ends of the legs comprise protrusions adapted to enhance a grip on at least one of a sea bottom, a river bed, and a submerged surface.

7. The apparatus according to claim 1, wherein the clamping members comprise cylinder piston assemblies.

8. The apparatus according to claim 1, wherein the legs are collapsible to a position in which they extend substantially in parallel and close to the beam.

9. The apparatus according to claim 1, further comprising a driver adapted to rotate the hinged connection between the legs and the beam.

10. The apparatus according to claim 9, wherein the driver comprises at least one cylinder piston assembly.

11. The apparatus according to claim 9, wherein the driver comprises a hoist extending between the beam and the legs.

12. The apparatus according to claim 1, wherein the lower ends of the legs are interconnected by a tension member.

13. The apparatus according to claim 1, wherein the length of the beam is variable.

14. The apparatus according to claim 1, wherein the frame comprises an upper part with stop members adapted to engage the tunnel section.

15. The apparatus according to claim 14, wherein the stop members are settable.

16. The apparatus according to claim 1, wherein the suspension device of the beam is adapted to cooperate with standardized hoisting lugs of the tunnel section.

17. The apparatus according to claim 1, further comprising a floating pontoon comprising the one or more lifting devices.

18. The apparatus according to claim 17, wherein the lifting devices are devised for cooperation with standardized hoisting lugs of the tunnel section.

19. The apparatus according to claim 17, wherein the pontoon comprises two sets of lifting devices spaced apart, each lifting device attached to a separate frame.

20. The apparatus according to claim 1, wherein the frame is devised for extending with its legs outwardly of the two opposite transverse sides of the tunnel section and extending with the beam above a roof of the tunnel section.

* * * * *

UNITED STATES PATENT AND TRADEMARK OFFICE

CERTIFICATE OF CORRECTION

PATENT NO. : 8,496,406 B2
APPLICATION NO. : 12/809891
DATED : July 30, 2013
INVENTOR(S) : Gerrit Martinus Hertgers It is certified that error appears in the above-identified patent and that said Letters Patent is hereby corrected as shown below:

In the Specification:

Column 1, line 7, delete "U.S.C." and insert -- 35 U.S.C. --.

In the Claims:

Column 6, line 20, in Claim 2, delete "beam" and insert -- beam, --.

Signed and Sealed this
Twenty-second Day of October, 2013

Teresa Stanek Rea

Teresa Stanek Rea
*Deputy Director of the United States Patent and Trademark Office*